US007337877B2

(12) United States Patent
Goenka et al.

(10) Patent No.: US 7,337,877 B2
(45) Date of Patent: Mar. 4, 2008

(54) VARIABLE GEOMETRY RESONATOR FOR ACOUSTIC CONTROL

(75) Inventors: Lakhi N. Goenka, Ann Arbor, MI (US); David J. Moenssen, Canton, MI (US); John D. Kostun, Brighton, MI (US); Christopher E. Shaw, Canton, MI (US)

(73) Assignee: Visteon Global Technologies, Inc., Van Buren Township, MI (US)

( * ) Notice: Subject to any disclaimer, the term of this patent is extended or adjusted under 35 U.S.C. 154(b) by 430 days.

(21) Appl. No.: 10/799,008

(22) Filed: Mar. 12, 2004

(65) Prior Publication Data

US 2005/0199439 A1 Sep. 15, 2005

(51) Int. Cl.
*F01N 1/02* (2006.01)

(52) U.S. Cl. ..... 181/250; 181/273; 181/266; 181/276; 181/277; 181/271; 181/278; 123/184.57; 123/184.56; 123/184.58; 123/184.59

(58) Field of Classification Search ..... 181/250, 181/273, 266, 276, 271, 277, 278; 123/184.57, 123/184.56, 184.58, 184.59
See application file for complete search history.

(56) References Cited

U.S. PATENT DOCUMENTS 3,940,721 A 2/1976 Kojima et al.
4,539,947 A 9/1985 Sawada et al.
4,546,733 A 10/1985 Kukami et al.
5,283,398 A 2/1994 Kotera et al.
5,377,629 A 1/1995 Brackett et al.
5,475,189 A * 12/1995 Field et al. ..... 181/241
5,894,823 A 4/1999 Lee
6,183,211 B1 * 2/2001 Wood ..... 417/254
6,422,192 B1 * 7/2002 Bloomer ..... 123/184.57
6,494,290 B1 12/2002 Jessberger
6,634,457 B2 10/2003 Paschereit et al.
6,792,907 B1 * 9/2004 Kostun et al. ..... 123/184.57
7,055,484 B2 * 6/2006 Marks et al. ..... 123/184.57
7,077,093 B2 * 7/2006 Koelmel et al. ..... 123/184.57

FOREIGN PATENT DOCUMENTS

JP 410102621 * 4/1998

* cited by examiner

*Primary Examiner*—Lincoln Donovan
*Assistant Examiner*—Forrest Phillips
(74) *Attorney, Agent, or Firm*—Brinks Hofer Gilson & Lione

(57) ABSTRACT

The present invention provides a resonator for attenuating acoustic vibration from an air intake passage. The resonator includes a neck, a resonator chamber, a piston-type member, and an actuator. The neck is attached between the air passage and the resonator chamber. The neck has two overlapping portions allowing the neck to extend within the resonator chamber. The piston-type member is located within the resonator chamber and is translated by the actuator to change the volume of the resonator and the neck length. By changing the volume and neck length of the resonator, the frequency attenuated by the resonator can be adjusted.

6 Claims, 2 Drawing Sheets

VARIABLE GEOMETRY RESONATOR FOR ACOUSTIC CONTROL

BACKGROUND

1. Field of the Invention

The present invention generally relates to a resonator for attenuating acoustic pressure pulsations from an engine.

2. Description of Related Art

Resonators for attenuating acoustic pressure pulsations in automotive applications are well known. The air induction systems of internal combustion engines produce undesirable noise in the form of acoustic pressure pulsations. This induction noise depends on the engine configuration and engine speed. The induction noise is caused by a pressure wave that travels from the inlet valve towards the inlet of the air induction system. The induction noise may be reduced by reflecting a wave toward the inlet valve 180° out of phase with the noise wave. As such, Helmholtz type resonators have been used to attenuate the noise wave generated from the inlet valve-opening event. In addition and more recently, resonators have been developed that change the volume of the resonator to adjust for varying frequencies of the noise wave, as engine speed changes. Previous designs however, have not provided a wide enough frequency range to attenuate various noise frequencies produced by the engine.

In view of the above, it is apparent that there exists a need for an improved resonator having broader flexibility to attenuate various noise frequencies of the engine.

SUMMARY

In satisfying the above need, as well as overcoming the enumerated drawbacks and other limitations of the related art, the present invention provides a resonator for attenuating acoustic pressure pulsations from an air intake passage. The resonator includes a neck, a resonator chamber, a piston-type member, and an actuator. The neck, attached between the air passage and the resonator chamber, has a plurality of overlapping portions allowing the neck to extend within the resonator chamber. The piston-type member is located within the resonator chamber and is translated by the actuator to change the volume of the resonator chamber and length of the neck. By changing the volume and neck length, the frequency attenuated by the resonator can be adjusted.

In one embodiment of the present invention, the resonator includes a second actuator coupled with the piston-type member and the neck. The second actuator is a motor and screw movable with the piston-type member and configured to vary the neck length.

In another embodiment of the present invention, the resonator includes a plate-type member coupled to the neck. The piston-type member may be driven to push against the second member thereby changing the resonator chamber volume and the neck length. A biasing member, such as a spring, is configured to bias the second member against a stop providing a default position for the second member.

Further objects, features and advantages of this invention will become readily apparent to persons skilled in the art after a review of the following description, with reference to the drawings and claims that are appended to and form a part of this specification.

DETAILED DESCRIPTION

Figure 1:
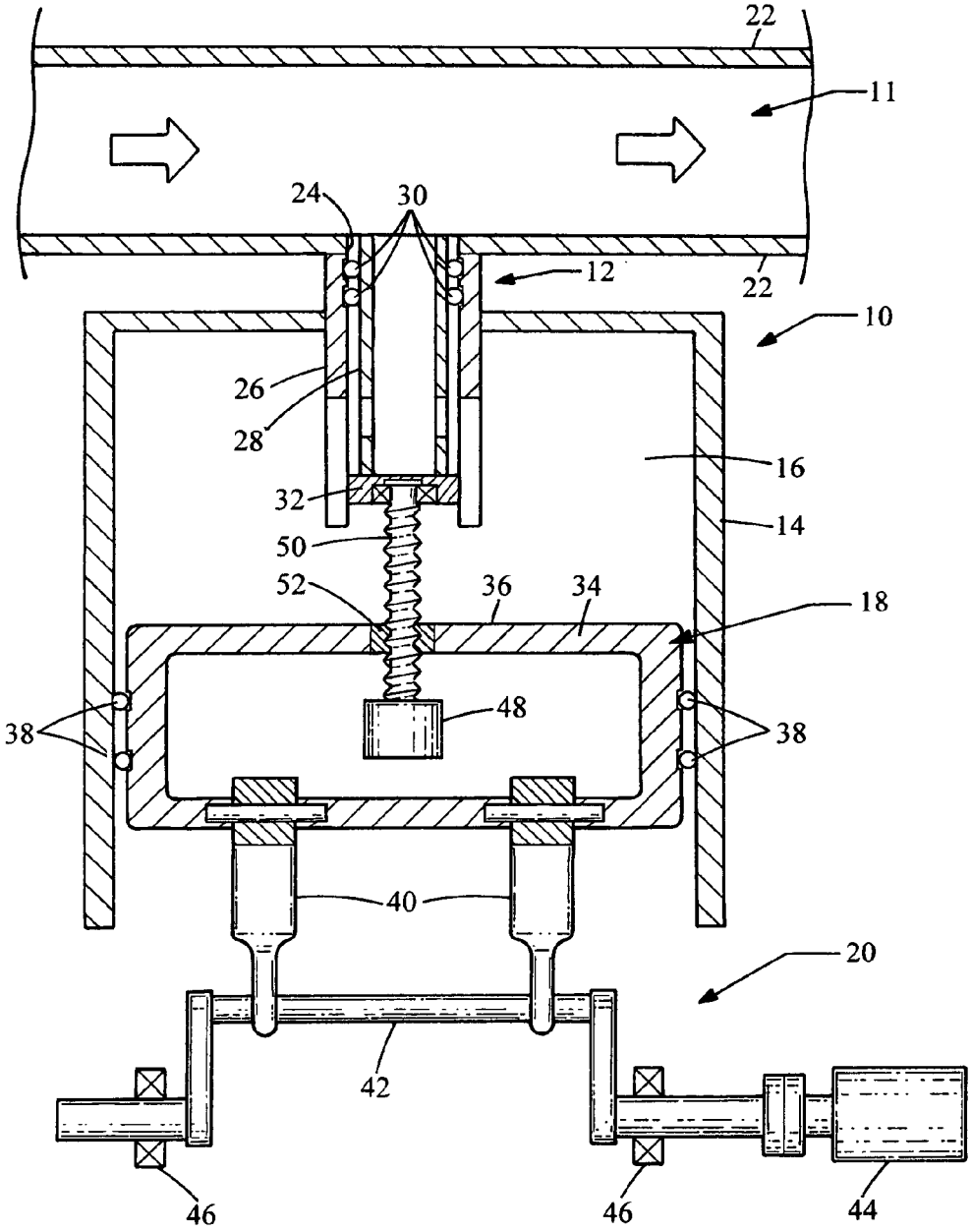
FIG. 1 is an embodiment of a variable geometry Helmholtz resonator in accordance with the present invention.

Now referring to FIG. 1, a resonator embodying the principles of the present invention is illustrated therein and designated at 10. The resonator 10 includes a neck 12, a resonator chamber 16, a member 18 and a actuator 20. The neck 12 is attached to an opening 24 in the walls 22 of an air intake 11.

Air flows through the air intake 11, part of the air induction system, to an engine (not shown). As an effect of the operation of the engine, a noise wave travels from the engine back through the air intake 11. Being coupled to the air intake 11, the resonator 10 attenuates the noise wave by reflecting the noise wave to the air intake 11 with a phase shift, thereby producing a canceling effect. The configuration shown where the noise wave enters and exits the resonator through the neck 12 is considered a side branch configuration.

The neck 12 has an outer wall 26 and an inner wall 28, with the outer wall 26 being stationary and the inner wall 28 being extendable into the resonator chamber 16, thereby increasing the neck length. Adjusting the neck length changes the frequency range attenuated by the resonator. Bearings 30 are provided between the inner wall 28 and the outer wall 26 to facilitate movement of the inner wall 28.

The resonator chamber 16 is formed by resonator walls 14 and the member 18, shown as a piston. Similar to the neck length, adjusting the volume of the chamber 16 also changes the frequency range attenuated by the resonator 10.

The member 18 includes a wall 34 having a surface 36 that cooperates with the resonator walls 14 to define the volume of the resonator chamber 16. A change in position of the member 18 allows adjustment of the volume of the resonator chamber 16. To facilitate movement of the member 18, bearings 38 are provided between the member 18 and the walls 14 of the resonator 10.

In addition, a actuator 20 is attached to the member 18 to move member 18, thereby changing the volume of the resonator chamber 16. The actuator 20 includes a motor 44 and a crank shaft 42. The crank shaft 42 is supported in bearings 46 and attached to the member 18 through connectors 40. As the motor 44 rotates the crank shaft 42, the connectors 40 produce movement of the member 18 relative to the resonator walls 14 and thereby change the volume of the resonator chamber 16 the neck length due to the coupling of the member 18 with the inner wall 28 of the neck 12.

A motor 48 is coupled to the wall 34 of the member 18 and is movable therewith. The motor 48 is connected to a screw 50 that is threaded through a nut 52 in the wall 34 of the member 18. Further, the screw 50 is attached to the inner wall 28 of the neck 12 through a coupling 32. The motor 48 may also be used to adjust the neck length by turning the screw 50 and thereby extending or retracting the inner wall 28 relative to the outer wall 26. As the noise frequency of the engine changes, the volume of the resonator chamber 16 and the neck length may be manipulated by the actuator 20 and motor 48 to attenuate the noise at a desired frequency.

Figure 2:
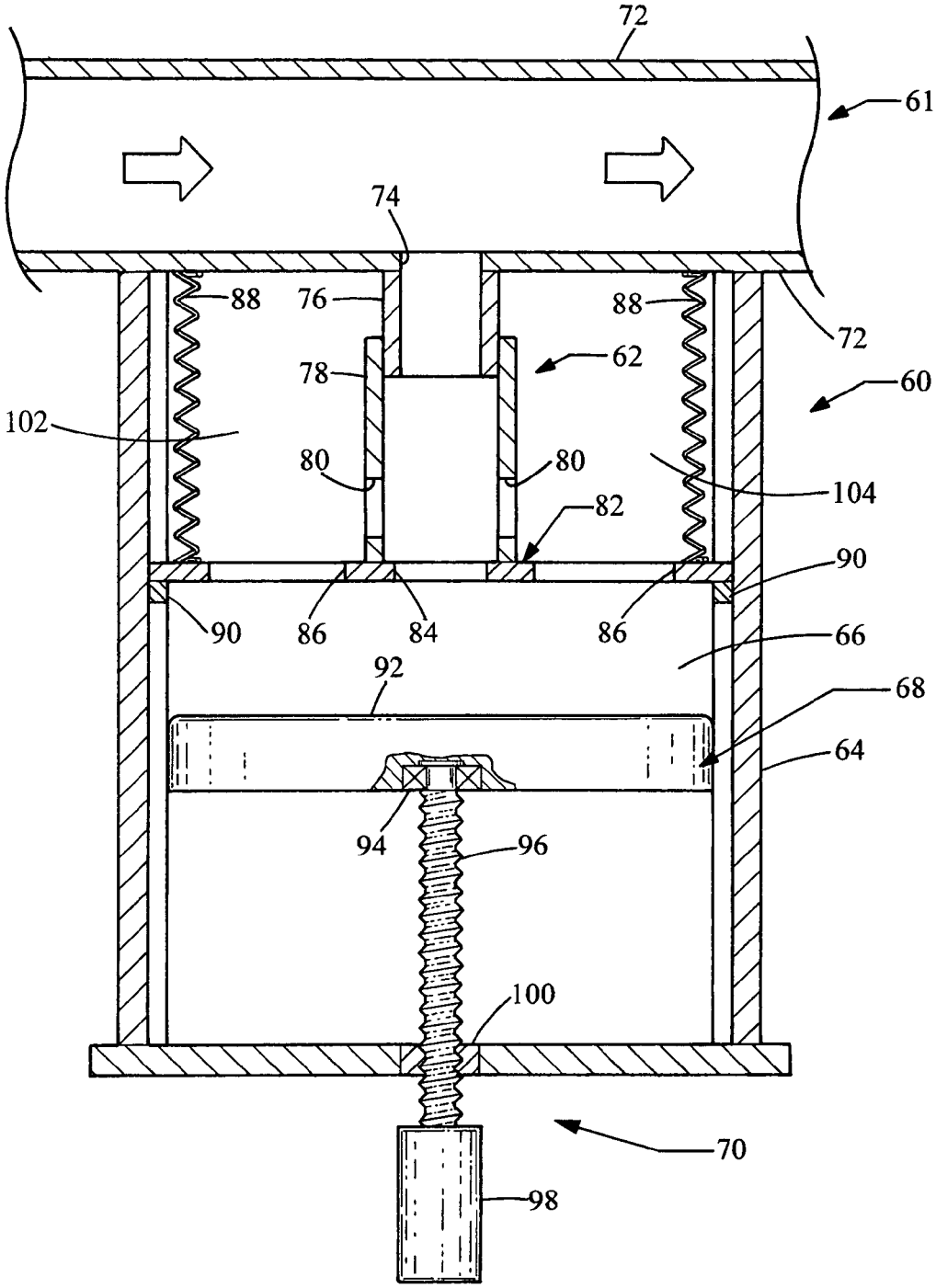
FIG. 2 is another embodiment of a variable geometry Helmholtz resonator in accordance with the present invention.

Now referring to FIG. 2, another embodiment of a resonator 60 in accordance with the present invention is provided. The resonator 60 includes a neck 62, a resonator chamber 66, a first member 68, a second member 82, and a actuator 70. The resonator chamber 66 is connected to the air intake 61 through neck 62. The neck 62 is connected to the air intake 61 of the induction system through an opening 74 in the walls 72 of the air intake 61. The neck 62 includes an inner wall 76 and an outer wall 78. To increase or decrease the neck length, the outer wall 78 is movable with respect to the inner wall 76, which may remain stationary. The outer wall 78 is connected to a second member 82 having an aperture 84 leading into the resonator chamber 66. The noise travels through opening 74, through the neck 62 and out of the opening 80 into the resonator chamber 66. Shown as a piston, the first member 68 has a surface 92 that cooperates with resonator wall 64 to define the volume of the resonator chamber 66. The first member 68 is movable within the chamber 66 by a actuator 70 thereby changing the volume of the chamber 66 and the frequency attenuated by the resonator 60.

The motor control device 70 includes a motor 98 coupled to a screw 96. The screw 96 is threaded through a nut 100 and has its end coupled to the first member 68 by a bearing 94. As the motor 98 drives the screw 96, the first member 68 is moved thereby changing the volume of the resonator chamber 66.

The first member 68 may be advanced against the second member 82. Coupled to biasing members 88 the second member 82 is biased against stops 90 thereby defining a default position of the second member 82. The second member 82 cooperates with the neck 62 and the walls 64 of the resonator 60 to define compartments 102, 104 of the resonator chamber 66. Noise is allowed to enter the compartments 102, 104 through openings 80 in the neck 62 and openings 84 and 86 in the second member 82. The compartments 102, 104 add to the total volume of the resonator chamber 66. Pushing against the bias members 88, the first member 68 may be advanced such that it moves the second member 82 away from the stops 90. Such movement of the second member 82 will decrease the neck length and the resonator chamber volume in conjunction with the compartments 102, 104.

As a person skilled in the art will readily appreciate, the above description is meant as an illustration of implementation of the principles this invention. This description is not intended to limit the scope or application of this invention in that the invention is susceptible to modification, variation and change, without departing from spirit of this invention, as defined in the following claims.

We claim:

1. A resonator for attenuating acoustic pressure pulsation from an air passage, the resonator comprising:

a neck attached in a side branch configuration with the air passage, the neck having a neck length;

at least one wall of the resonator forming a resonator chamber;

a first member located within the resonator chamber, the first member cooperating with the at least one wall to form a resonator volume;

a first actuator coupled to the first member and configured to translate the first member changing the resonator volume and the neck length; and a second actuator coupled with the first member and the neck, the second actuator being configured to adjust the neck length relative to a position of the first member.

2. The resonator according to claim 1, wherein the second actuator is configured to vary the neck length.

3. The resonator according to claim 1, wherein the second actuator includes a motor and a screw.

4. The resonator according to claim 1, wherein the second actuator is configured to manipulate a second member that engages the neck and the first member.

5. The resonator according to claim 1, wherein the first actuator is a motor and crankshaft.

6. A resonator for attenuating acoustic vibration from an air passage, the resonator comprising:

a neck attached in a side branch configuration with the air passage, the neck having a neck length;

at least one wall of the resonator forming a resonator chamber;

a first member located within the resonator chamber, the first member cooperating with the at least one wall to form a resonator volume;

an actuator coupled to the first member and configured to translate the first member changing the resonator volume and the neck length; and a second member coupled to the first member and the neck, the second member being configured to change the resonator volume in relation to the neck length.

* * * * *